US005078000A

United States Patent [19]

Matsuo et al.

[11] Patent Number: 5,078,000

[45] Date of Patent: Jan. 7, 1992

[54] ROLLING MILL WITH INTERCHANGEABLE ROLLER APPARATUS

[75] Inventors: Giichi Matsuo; Akio Mehara; Fumiyuki Yamaguchi, all of Tokyo, Japan

[73] Assignee: NKK Corporation, Tokyo, Japan

[21] Appl. No.: 702,105

[22] PCT Filed: Jan. 6, 1988

[86] PCT No.: PCT/JP88/00004

§ 371 Date: Jun. 15, 1989

§ 102(e) Date: Jun. 15, 1989

Related U.S. Application Data

[63] Continuation of Ser. No. 602,924, Oct. 18, 1990, abandoned, which is a continuation of Ser. No. 381,651, Jun. 15, 1989, abandoned.

[30] Foreign Application Priority Data

Dec. 28, 1987 [JP] Japan ..... 62-334640

[51] Int. Cl.[5] ..... B21B 31/08; B21B 35/02

[52] U.S. Cl. ..... 72/238; 72/249

[58] Field of Search ..... 72/235, 238, 239, 249

[56] References Cited

U.S. PATENT DOCUMENTS

| | | | |
|---|---|---|---|
| 1,387,650 | 8/1921 | Koelkebeck | 72/235 |
| 3,600,926 | 8/1971 | Hinterholzl | 72/249 |

FOREIGN PATENT DOCUMENTS

| | | | |
|---|---|---|---|
| 1040481 | 10/1958 | Fed. Rep. of Germany | 72/249 |
| 56-23303 | 3/1981 | Japan . | |
| 57-130704 | 8/1982 | Japan | 72/238 |
| 60-191607 | 9/1985 | Japan . | |
| 981038 | 1/1965 | United Kingdom | 72/239 |
| 0147965 | 7/1985 | United Kingdom | 72/249 |

OTHER PUBLICATIONS

Veb Verlag Technik Berlin 1961, Walzwerks-Und Schmiedemaschinen Prof. Dr.-Ing. A. Geleji, pp. 500-519.

*Primary Examiner*—Lowell A. Larson
*Assistant Examiner*—Thomas C. Schoeffler
*Attorney, Agent, or Firm*—Frishauf, Holtz, Goodman & Woodward

[57] ABSTRACT

A rolling mill in which the direction of rolls, in a rolling system for rolling bar steel, can be shifted from horizontal to vertical or from vertical to horizontal. The rolling mill comprises a pair of first shafts removably connected individually, by means of universal joints, to a pair of spindles to which a rotatory force for rolling is transmitted, a second shaft disposed substantially parallel to the first shafts, and a pair of rolls disposed so that the axes thereof extend at right angles to the second shaft, so that the rolls are interchangeable as a whole, whereby the rolling direction can be shifted from horizontal to vertical or from vertical to horizontal. In this case, the first and second shafts are connected to each other by means of a series gear train, and the second shaft includes a pair of bevel gears directed opposite to each other, the bevel gears individually engaging bevel gears on the shafts of the rolls.

12 Claims, 8 Drawing Sheets

ROLLING MILL WITH INTERCHANGEABLE ROLLER APPARATUS

This application is a Continuation of application Ser. No 07/602,924, filed Oct. 18, 1990, abandoned which in turn is a Continuation of Ser. No. 07/381,651 filed June 15, 1989 (abandoned).

TECHNICAL FIELD

The present invention relates to a rolling mill with interchangeable roller apparatus in which the direction of the rolls in a rolling system for rolling bar steel is shifted from horizontal to vertical or from vertical to horizontal by changing only the rolls, i.e. without having to replace the drive system.

BACKGROUND ART

Usually, in rolling bar steel, round bars and flat bars are rolled in a manner different from that for angles and channels, due to the difference between their cross-sectional configurations, so that it is very difficult to roll the two types on the same rolling line. More specifically, the former type is ideally finished into products by alternately arranging horizontal rolling mills and vertical rolling mills on the rolling line and alternately applying pressure in the directions of thickness and width. For the latter type, however, a pressure must be successively increased while being gradually applied in a same direction, so that only horizontal rolls are provided on the rolling line, whereby products are finished by successively repeating pressure in the direction of thickness.

In consideration of these circumstances, "convertible type rolling mills" in which stands are capable of horizontal-vertical shifts have recently been put into practical use. In these convertible type rolling mills, stands are rearranged depending on the type of raw material to be rolled to be fed along a line, and various bar steels, such as round bars, flat bars, angles, channels, etc., can be rolled on the same rolling line.

FIGS. 8 and 9 show an example of a convertible type rolling mill. When a roll of the rolling mill 1 is in a vertical position, guide stand 4 is in an upright position, as shown in FIG. 8, and the rotational force of motor 6 is transmitted to the rolls of rolling mill 1 successively, through universal joint 5, speed reducer 3, and universal joint 2. In shifting the roll of rolling mill 1 to a horizontal position, on the other hand, speed reducer 3 and universal joint 2, along with guide stand 4, are rearranged as shown in FIG. 9.

FIGS. 10 and 11 show another convertible type rolling mill. In making a shift from the horizontal position shown in FIG. 10 to the vertical position shown in FIG. 11, rollers 7 and speed reducer 10 are separated at the location of universal joint 9, rollers 7 are mounted in the vertical position in guide stand 8 which contains a speed-reduction distributing gear therein, and universal joint 9 is coupled to guide stand 8. The force of rotation of motor 11 around a horizontal axis is transmitted, as a force of rotation around a vertical axis, to a roll of rollers 7 by means of the speed-reduction distributing gear of guide stand 8.

Further, FIG. 12 shows a convertible type rolling mill of another type, in which vertical type rolling mill (inner stand) 12 is incorporated in guide stand 19. In this type, the rotatory force of motor 17 is transmitted to a pair of universal spindles 13 through speed reducer 16 and gear boxes 14 and 15. In making a shift from vertical to horizontal, vertical inner stand 12 is removed, and a horizontal inner stand (not shown) is incorporated in guide stand 19. The horizontal inner stand and speed reducer 16 are coupled by means of another pair of universal spindles 18 having a horizontal axis.

In the first, second, and third convertible type rolling mills described above, however, the guide stand to receive the inner stand has a complicated mechanism, so that its maintenance requires much labor, and the machine itself is expensive. In the rolling mills of these types, therefore, partial reconstruction utilizing existing line equipment is hardly possible, so that new equipment must be installed after removing all the existing equipment. Thus, the equipment cost is enormous, and uneconomical. In the first and second rolling mills, moreover, the stand rearrangement requires a lot of time, thus retarding the whole operation and lowering productivity.

The present invention has been contrived in consideration of these circumstances, and its object is to provide a rolling mill with interchangeable roller apparatus in which the rearrangement of stands can be achieved by a minor reconstruction of existing equipment, and horizontal-vertical shifts can be effected in a short period of time.

SUMMARY OF THE INVENTION

One aspect of the invention is directed to a rolling mill adapted for operation with interchangeable sets of vertically and horizontally oriented rolls. The rolling mill includes a guide stand having hold means for securing an inner stand to the guide stand. A pair of main spindles, respectively connected to a pair of universal spindles, transmits a rotary force originating from a motor drive, each of the main spindles having a coupling member at one end thereof for connecting the universal spindle to a corresponding one of the main spindles. The inner stand includes the following:

(a) a pair of first power transmitting shaft members individually and removably connected to the pair of main spindles by means of the coupling members, for rotational movement in response to the rotary force transmitted by the main spindles; (b) first gears at ends of first power transmission shaft members opposite the coupling members; (c) a second power transmission shaft member disposed substantially parallel to the axes of the first power transmission shaft members; (d) a second gear on the second power transmission shaft member and arranged to be driven by the first gears of the first power transmission shaft members; the first gears and second gear defining a series gear train; (e) a pair of first bevel gears disposed on the second power transmission shaft member so as to oppose one another; (f) a pair of rolls each having a respective roll shaft member whose axis extends at right angles to the axis of the second power transmission shaft member, such rolls being located substantially at the same level as the first power transmission shaft members or at a lower level than that of the first power transmission shaft members; (g) a second bevel gear operatively engaging the roll shaft member of the corresponding one of the rolls; and (h) a body for incorporating the shaft members, the gears and the rolls.

The first bevel gears in the above-described arrangement are arranged to individually engage corresponding ones of the second bevel gears on the roll shaft members, and at least one of the first bevel gears engages the second power transmission shaft member for sliding movement in the axial direction of the second power transmission shaft member, so that the pair of rolls with associated second bevel gears are brought into an operating position wherein the at least one of the first bevel gears is urged along the second power transmission shaft member into engagement with a confronting end of the second bevel gears.

The rolls are arranged to be movable in an axial direction thereof, together with the shaft members and the gears. The pair of rolls of the inner stand in this arrangement are replaceable for a perpendicularly oriented pair of other rolls that are directly driven by and detachable from the pair of universal spindles.

BEST MODE OF CARRYING OUT THE INVENTION

Various embodiments of the present invention will now be specifically described with reference to the accompanying drawings.

Referring to FIGS. 1 to 5, a first embodiment will be described.

Figure 4:
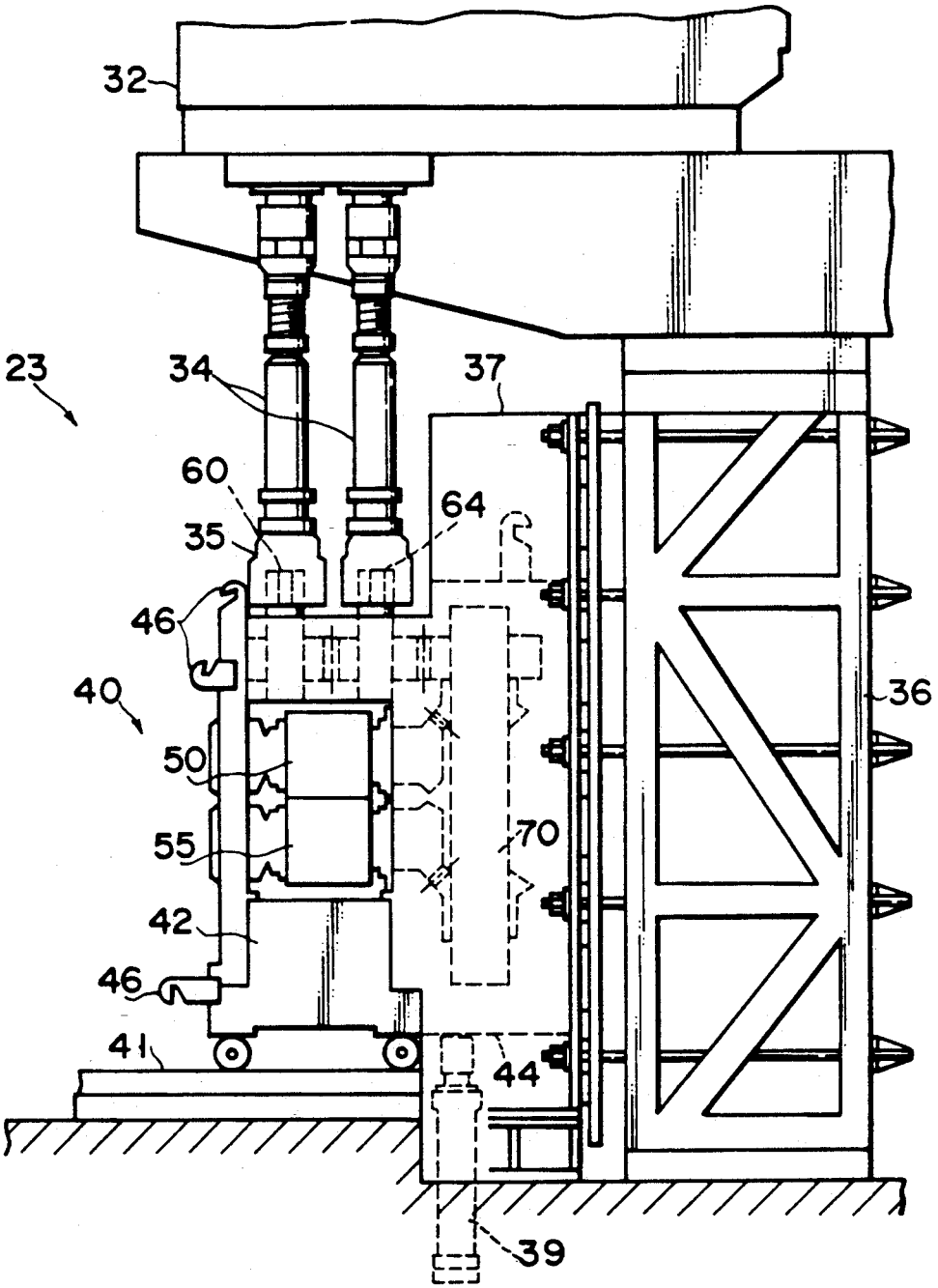
FIG. 4 is a diagram showing a stand fitted with the rolling mill of the first embodiment.
Figure 5:
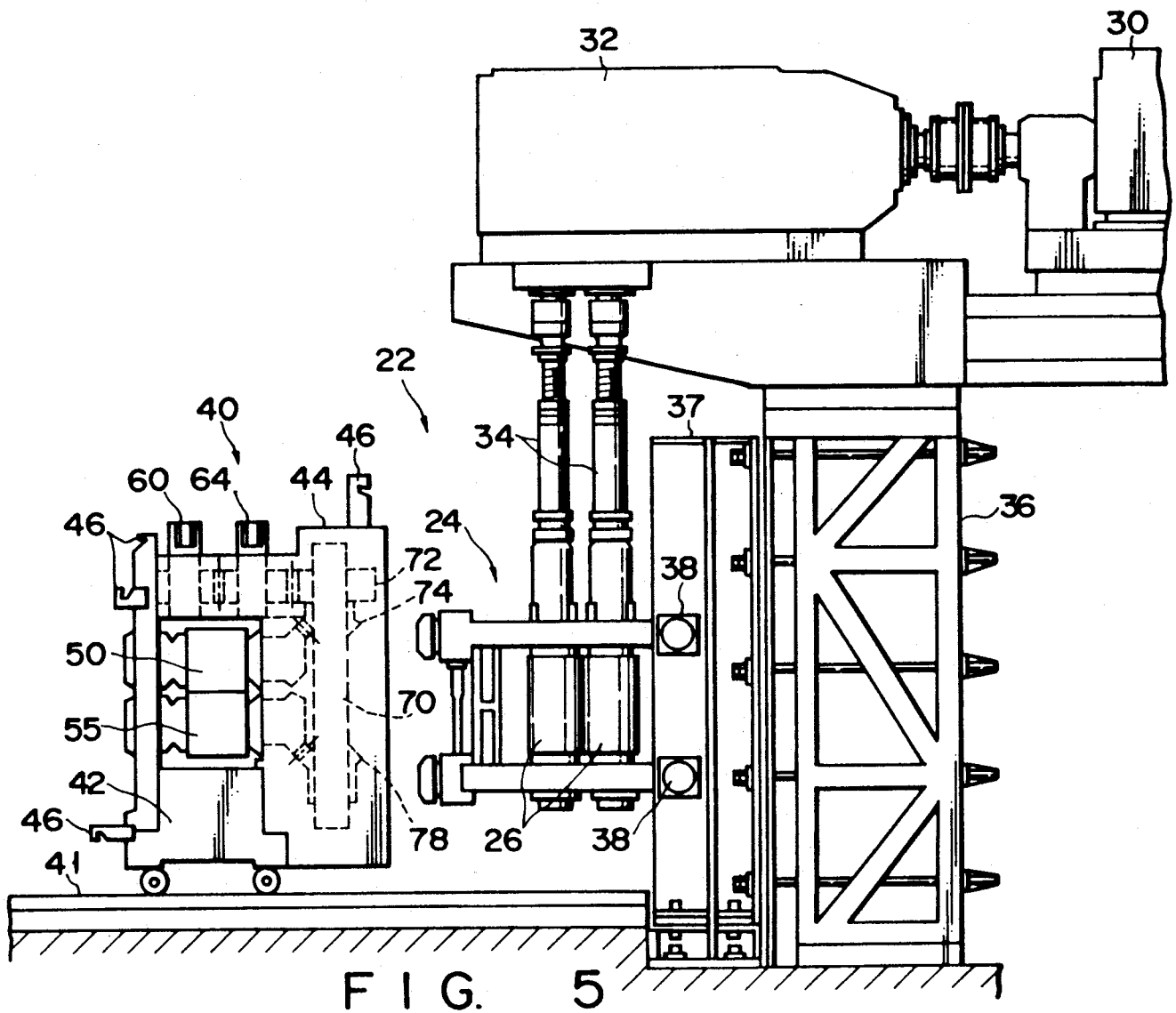
FIG. 5 is a diagram for illustrating a case where the rolling mill of the first embodiment is incorporated in the stand.

As shown in FIGS. 4 and 5, motor 30 and speed reducer 32 are provided on steel frame 36 which is embedded in concrete wall (not shown), whereby power is transmitted to a rolling mill located below. Guide stand 37 is attached to the side face of steel frame 36, and the rolling mill (inner stand) is held by means of two pairs of hydraulic cylinders 38 of guide stand 37. Rail 41 is laid extending from the location of installation of a crane (not shown) to a position in front of guide stand 37, at right angles to the rolling line. Truck 42 carrying inner stand 40 travels on rail 41. As shown in FIG. 4, following vertical-horizontal shift, first shafts (first power transmission shafts) 60 and 64 of inner stand 40, having a pair of horizontal rolls, are connected individually, by means of couplings 35, to adjustable spindles 34 which extend below speed reducer 32.

Figure 1:
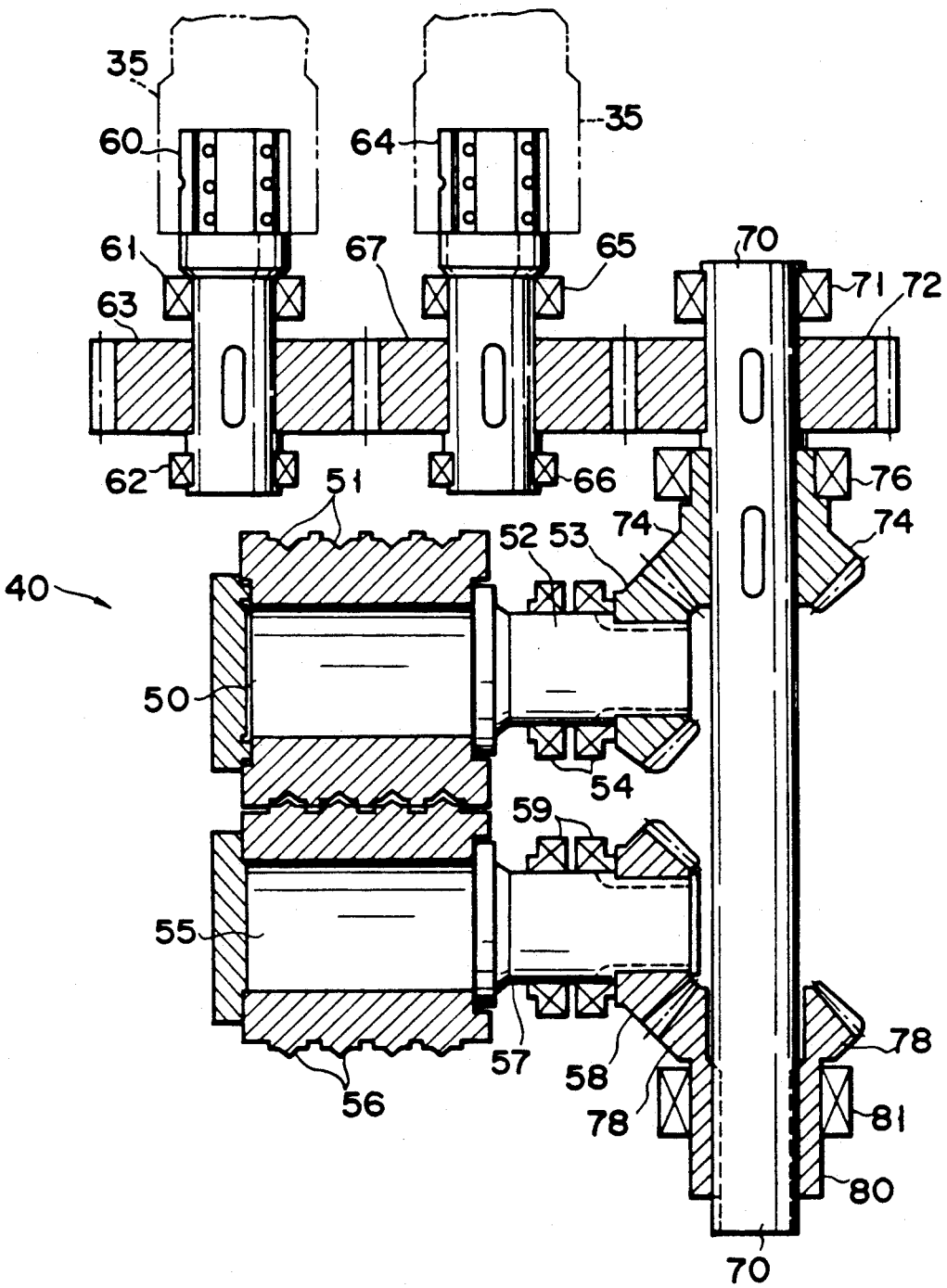
FIG. 1 is a diagram schematically showing a principal part of a rolling mill with interchangeable roller apparatus according to a first embodiment of the present invention.
Figure 2:
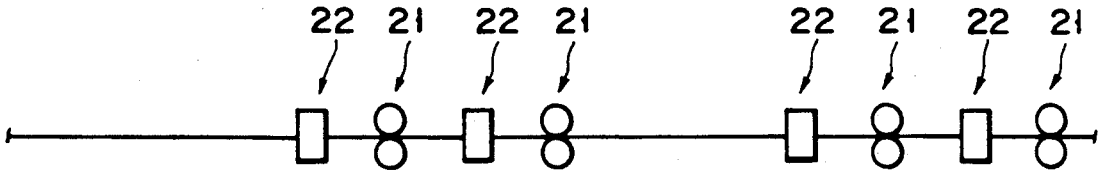
FIG. 2 is a diagram showing a rolling line before rearrangement.
Figure 3:
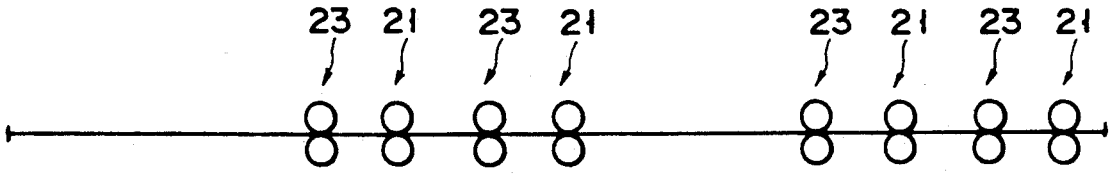
FIG. 3 is a diagram showing a rolling line after rearrangement.

In inner stand 40, as shown in FIG. 1, the pair of first shafts 60 and 64 are designed so as to be locked when their upper portions are inserted into couplings 35. Shafts 60 and 64 are rotatably supported inside a gear box (not shown) by means of a pair of bearings 61 and 62 and a pair of bearings 65 and 66, respectively. Helical gears 63 and 67, having equal diameters and equal numbers of teeth, are mounted on the lower portions of their corresponding shafts so as to mesh with each other. Also, helical gear 67 of first shaft 64 (on the side of guide stand 37) is in mesh with gear 72 in the upper portion of second shaft (second power transmission shaft) 70. Thus, first shafts 60, 64 and second shaft 70 are arranged parallel and substantially at regular intervals, and gears 63, 67 and 72 constitute a series gear train. This gear train is immersed in oil in the gear box. Second shaft 70 extends downward longer than first shafts 60 and 64, and further, has a pair of skew bevel gears 74 and 78. The respective engaging surfaces of the pair of skew bevel gears 74 and 78 are inclined at about 45°, so as to face toward each other. Upper skew bevel gear 74 is situated right under gear 72 of the gear train so as to be in mesh with skew bevel gear 53 of upper roll 50. On the other hand, lower skew bevel gear 78 is located at the lower portion of shaft 70 so as to be in mesh with skew bevel gear 58 of lower roll 55. Ring portion of bevel gear 78 is engaged in a spline of shaft 70 such that it can be slid up and down at the lower portion of shaft 70 by means of a depressing device (hydraulic drive) contained in truck 42. As shown in FIG. 4, rolling mill body (inner stand) 44 is supported for up-and-down motion by means of jack 39 thereunder so that it is vertically adjustable. Shaft 70 itself is rotatably supported by means of bearing 71, and the pair of bevel gears 74 and 78 are rotatably supported by means of bearings 76 and 81, respectively. Four depressions 51 for angle-steel (angle) rolling are formed on the roll surface of upper roll 50. On the other hand, four projections 56 are formed on the roll surface of lower roll 55 so that they are fitted in depressions 51 of upper roll 50. Shafts 52 and 57 of upper and lower rolls 50 and 55 are rotatably supported by means of a pair of bearings 54 and a pair of bearings 59, respectively. Ring portion of bevel gears 53 and 58 are each engaged in a spline of shaft 52 and 57, and are mounted so as to be slidable along roll shafts 52 and 57, respectively.

In this case, roller bearings with high yield strength are used for bearings 54, 59, 61, 62, 65, 66, 71, 76 and 81. Gears 53, 58, 63, 67, 72, 74 and 78 are made of special steel, such as case-hardened steel.

In this case, first shafts 60, 64 and second shaft 70 have a diameter of about 140 mm, and gears 63, 67 and 72, which constitute the gear train, have a diameter of about 420 mm and a thickness of about 150 mm each. The maximum diameter of each of bevel gears 53, 58, 74 and 78 is about 350 mm.

Hooks 46 are attached to various parts of body 44 of rolling mill 40, whereby rolling mill 40 can be suspended in both vertical and horizontal directions.

Referring now to FIGS. 4 and 5, shifting the direction of the rolling mill from vertical to horizontal, by replacing an existing vertical rolling mill with the replaceable rolling mill, will be described.

A truck (not shown) separate from truck 42 is held on stand-by right under vertical rolling mill (inner stand) 24, a handle (not shown) of universal spindles 34 is turned to retain spindles 34, and the holding force of hydraulic cylinders 38 of guide stand 37 is then reduced to lower inner stand 24. When the weight of inner stand 24 is moved onto the truck, inner stand 24 is removed from the rolling line, rolling mill 40, for use as a horizontal inner stand, is suspended together with truck 42 by means of the crane, to be placed on rail 41, and truck 42 is driven toward guide stand 37. When truck 42 reaches the rolling line, universal spindles 34 are lowered, and first shafts 60 and 64 are inserted individually into couplings 35 to be connected thereto. Further, jack 39 is raised to align the gap position of rolls 50 and 55 of rolling mill 40 with a path line of bar steel. When rods of hydraulic cylinders 38 of guide stand 37 are projected so as to support and fix rolling mill 40 from both sides thereof, installation of rolling mill 40 is completed.

When preparations are made for rolling in this manner, a power switch of motor 30 is turned on, and the rotatory driving force of motor 30 is transmitted to the pair of spindles 34 through speed reducer 32. The respective rotations of the pair of spindles 34 are made opposite to each other by speed reducer 32, and are transmitted to gears 63 and 67 of first shafts 60 and 64. The rotatory forces of gears 63 and 67 are combined and transmitted to gear 72 which constitutes the gear train. At shaft 70 of gear 72, the resultant rotatory force is distributed to upper and lower rolls 50 and 55 through bevel gears 74 and 78. At this time, the engaging surfaces of bevel gears 74 and 53 and the engaging surfaces of bevel gears 78 and 58 face one another, so that upper and lower rolls 50 and 55 rotate in opposite directions. The material or angle steel to be rolled, which is heated in a heating furnace, is rolled to predetermined dimensions by means of a train of rough rolling mills, and rolling is then executed in accordance with a path schedule by means of stand 23, shifted from a vertical position to a horizontal position, and existing horizontal stand 21. In this replaceable rolling mill, the material is depressed by raising lower roll 55 by means of the hydraulic device in truck 42.

According to the first embodiment described above, the vertical-horizontal shift of the stands can be completed in a short period of time, and the productivity can be improved by rapid operation. Since the existing motor and speed reducer can be utilized as they are, moreover, the rearrangement of the stands can be achieved by a minor reconstruction, so that the equipment cost can be reduced considerably.

In the aforementioned embodiment, moreover, only the gear of one of the first shafts (first power transmission shafts) is in mesh with the gear of the second shaft (second power transmission shaft), in the series gear train. The gear train may, however, be variously modified without being limited to this arrangement.

Although the case of rolling angle steel (angle) has been described in connection with the aforementioned embodiment, furthermore, channel steel (channel) or other bar steel may be rolled without being limited to the embodiment.

Figure 6:
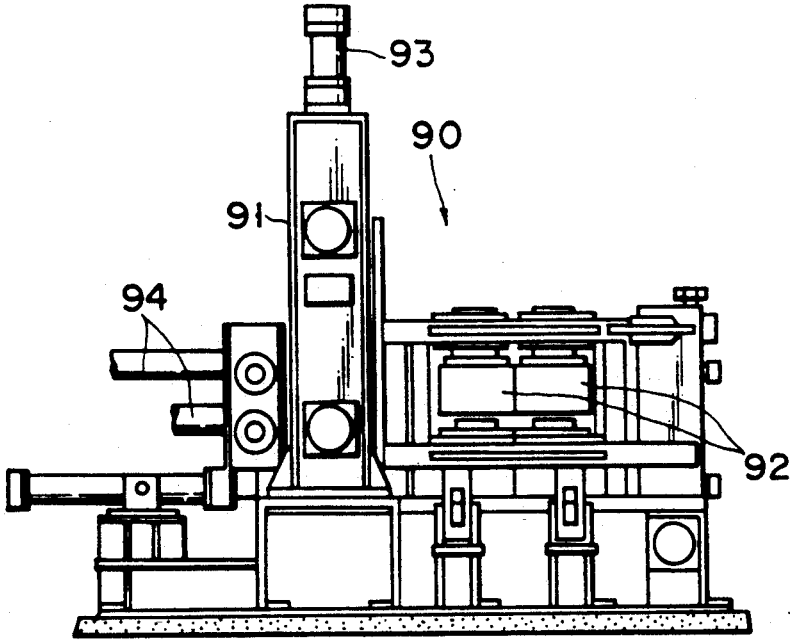
FIGS. 6 and 7 are a side view and a front view, respectively, showing a rolling mill with interchangeable roller apparatus according to a second embodiment.
Figure 7:
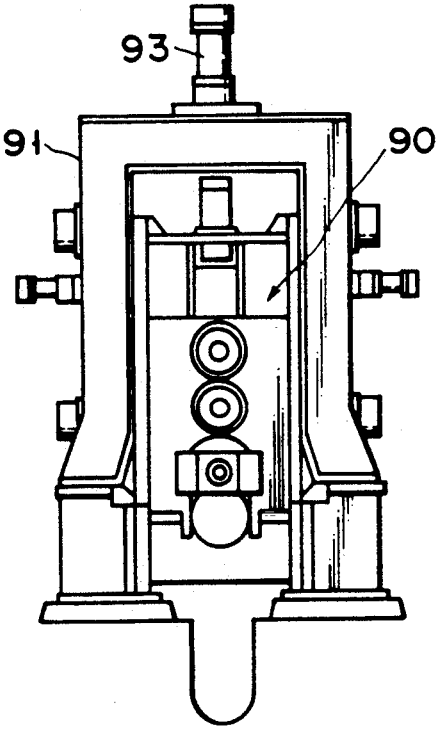
Figure 8:
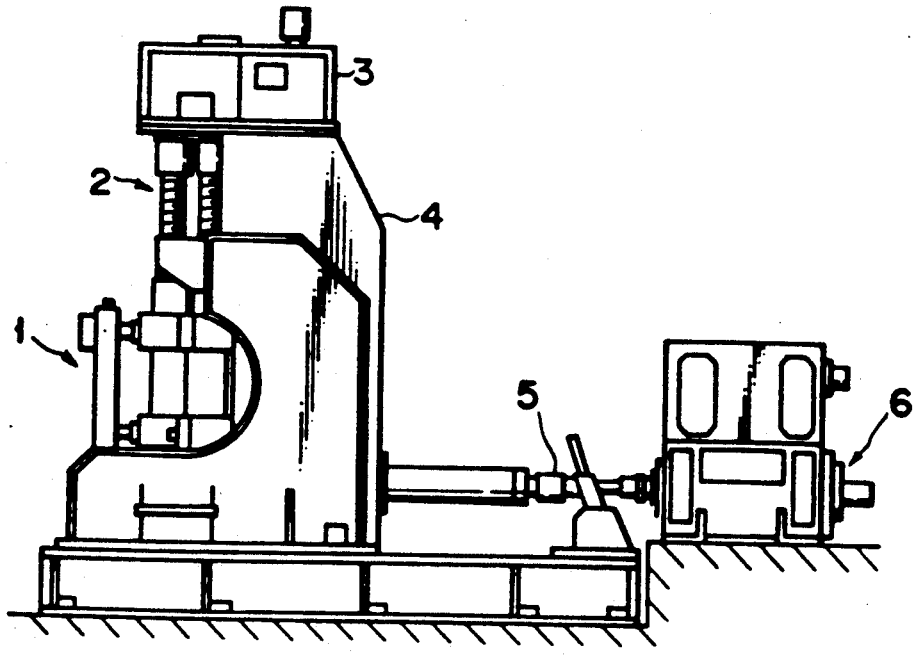
FIG. 8 (PRIOR ART)
FIGS. 8 to 12 are side views individually showing prior art rolling mills.
Figure 9:
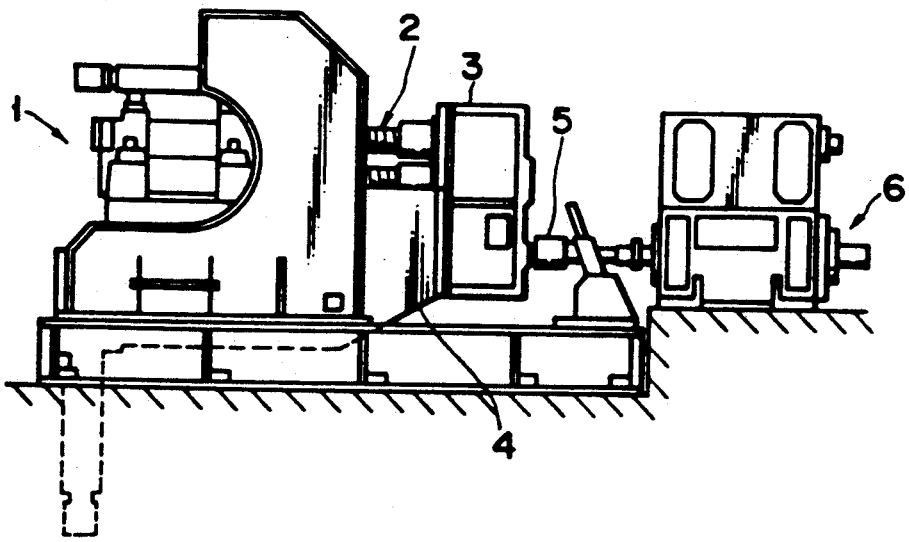
FIG. 9 (PRIOR ART)
Figure 10:
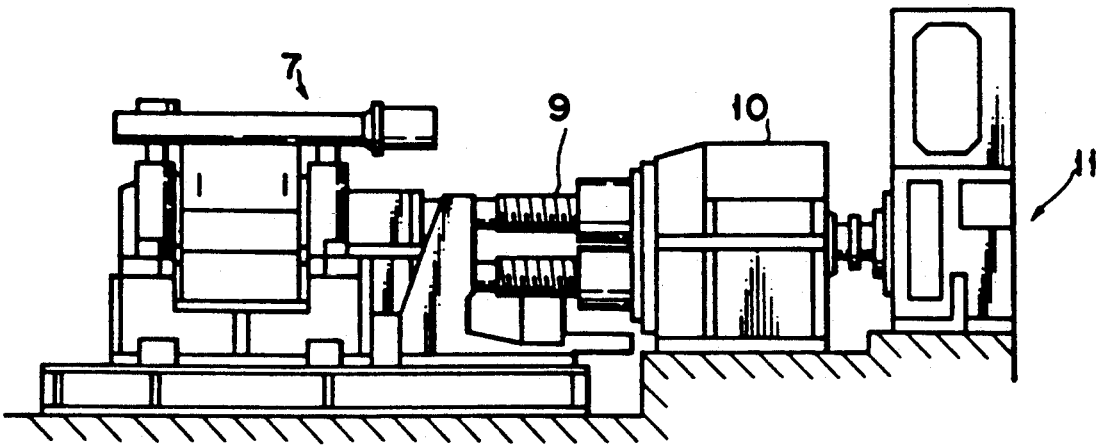
FIG. 10 (PRIOR ART)
Figure 11:
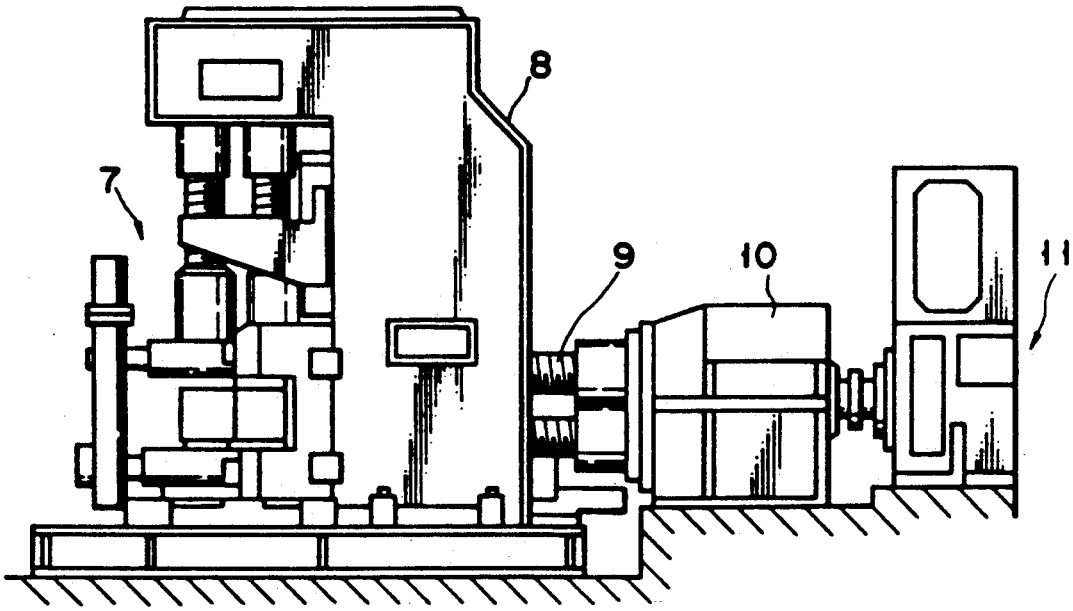
FIG. 11 (PRIOR ART)
Figure 12:
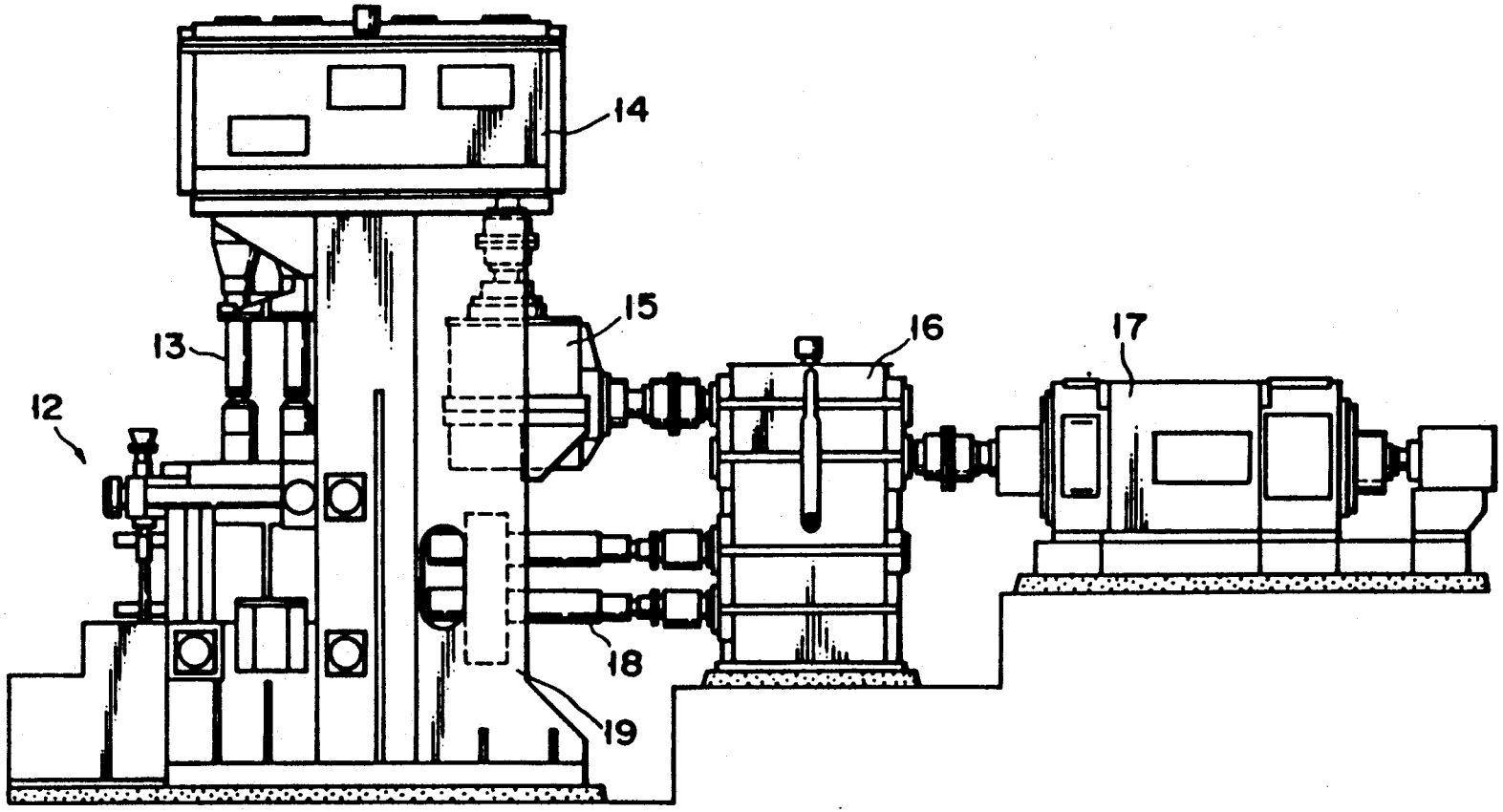
FIG. 12 (PRIOR ART)

Referring now to FIGS. 6 and 7, a second embodiment will be described.

In this second embodiment, rolling mill (inner stand) 90, similar to the rolling mill described in connection with the first embodiment, is incorporated as a vertical rolling mill in an existing horizontal rolling mill, thereby shifting stands from a horizontal position to a vertical position. More specifically, a pair of rolls 92 of rolling mill 90 are mounted on an existing horizontal rolling stand so that they assume a vertical posture, and a motor rotatory force is transmitted to rolls 92 via universal spindles 94. Further provided is lift device 91 having cylinder 93, whereby inner stand 90 is moved up or down.

According to the second embodiment described above, the existing stand can be interchanged with a vertical stand, which can be utilized also for edger rolling and the like.

According to the second embodiment described above, moreover, the path level of rolls 92 can be adjusted by means of lift device 93.

INDUSTRIAL AVAILABILITY

According to the present invention, special bar steel, such as angle steel, can be rolled by partially reconstructing an existing alternately arranged horizontal-vertical rolling line, without newly installing a continuous horizontal-horizontal rolling line. Therefore, round bars, flat steel, angle steel, and channel steel can be subjected to twist-free rolling (continuous rolling in an unchanged posture without 90° rotation) on the same rolling line. Since existing equipment can be utilized after a minor reconstruction, moreover, the equipment cost can be reduced considerably. Since the rolling mill itself is compact and simple in construction, furthermore, the stand rearrangement can be completed in a short period of time, thus ensuring improved productivity. Also, a shift from horizontal to vertical, as well as a shift from vertical to horizontal, can be effected, so that rearrangement of any stands can be applied.

We claim:

1. A rolling mill adapted for operation with interchangeable sets of vertically and horizontally oriented rolls, comprising:

a guide (37) stand having hold means (38) for securing an inner stand (40) to said guide stand;

a pair of main spindles, respectively connected to a pair of universal spindles, for transmitting a rotary force originating from a motor drive, each of said main spindles having a coupling member (35) at one end thereof for connecting said universal spindle to a corresponding one of said main spindles;

said inner stand including;

(a) a pair of first power transmitting shaft members (60, 64) individually and removably connected to said pair of main spindles by means of said coupling members, for rotational movement in response to said rotary force transmitted by said main spindles;

(b) first gears (63, 67) at ends of said first power transmission shaft members opposite said coupling members;

(c) a second power transmission shaft member (70) disposed substantially parallel to the axes of said first power transmission shaft members;

(d) a second gear (72) on said second power transmission shaft member and arranged to be driven by said first gears of said first power transmission shaft members;

said first gears and second gear defining a series gear train;

(e) a pair of first bevel gears (74, 78) disposed on said second power transmission shaft member so as to oppose one another;

(f) a pair of rolls (50, 55), each having a respective roll shaft member (52, 57) whose axis extends at right angles to the axis of said second power transmission shaft member, said rolls being located substantially at the same level as said first power transmission shaft members or at a lower level than that of said first power transmission shaft members;

(g) a second bevel gear (53, 58) operatively engaging said roll shaft member of the corresponding one of said rolls; and (h) a body (44) for incorporating said shaft members (52, 57, 60, 64, 70), said gears (53, 58, 63, 67, 72, 74, 78) and said rolls (50, 55);

wherein said first bevel gears are arranged to individually engage corresponding ones of the second bevel gears on said roll shaft members, and at least one of said first bevel gears engaging said second power transmission shaft member for sliding movement in the axial direction of said second power transmission shaft member, so that said pair of rolls with associated second bevel gears are brought into an operating position wherein said at least one of said first bevel gears is urged along said second power transmission shaft member into engagement with a confronting one of said second bevel gears;

wherein said rolls are movable in an axial direction thereof, together with said shaft members and said gears; and whereby said pair of rolls of the inner stand are replaceable for a perpendicularly oriented pair of other rolls that are directly driven by and detachable from said pair of universal spindles.

2. A rolling mill according to claim 1, wherein said body comprises a plurality of lifting members for lifting the entire inner stand as a single unit.

3. A rolling mill according to claim 1, wherein said pair of main spindles are vertically oriented.

4. A rolling mill according to claim 1, wherein said pair of main spindles are horizontally oriented.

5. A rolling mill according to claim 1, wherein said pair of rolls each comprise a roll face having a plurality of grooves or projections.

6. A rolling mill according to claim 1, wherein each of said first bevel gears engages said second power transmission shaft member for sliding movement in the axial direction of said second power transmission shaft member.

7. A rolling mill according to claim 1, wherein said second power transmission shaft member is arranged to extend vertically and has a spline formed in a lower portion thereof, and a lower one of said first bevel gears is slidable in the vertical direction along said spline.

8. A rolling mill according to claim 1, wherein said first gears of said first power transmission shaft members are helical gears.

9. A rolling mill according to claim 1, wherein said roll shaft members have splines formed therein, respectively, in which ring portions of said second bevel gears are engaged, thereby enabling said rolls to slide in the axial direction thereof.

10. A rolling mill according to claim 1, wherein said hold means comprises a plurality of hydraulic cylinders.

11. A rolling mill according to claim 1, wherein said second power transmission shaft member is arranged on a side close to said guide stand.

12. A rolling mill according to claim 1, wherein said inner stand is located on a truck movable on rails.

* * * * *